US005807193A

United States Patent [19]

Talarico et al.

[11] Patent Number: 5,807,193

[45] Date of Patent: Sep. 15, 1998

[54] ADJUSTABLE BALL BACKSTOP

[75] Inventors: Mark Talarico; Matthew Arndt; Richard Grapenthin, all of Van Nuys, Calif.

[73] Assignee: Jas D. Easton, Inc., Van Nuys, Calif.

[21] Appl. No.: 853,892

[22] Filed: May 9, 1997

[51] Int. Cl.[6] ..... A63B 69/40

[52] U.S. Cl. ..... 473/421

[58] Field of Search ..... 473/435, 421, 473/422, 475, 476, 481, 158, 164, 166

[56] References Cited

U.S. PATENT DOCUMENTS

| | | | |
|---|---|---|---|
| D. 353,424 | 12/1994 | Way . | |
| 849,941 | 4/1907 | Titus | 473/421 |
| 2,944,816 | 7/1960 | Dixon . | |
| 3,180,643 | 4/1965 | Kallai . | |
| 3,672,672 | 6/1972 | Rubin | 473/421 |
| 3,698,712 | 10/1972 | Pero . | |
| 3,711,092 | 1/1973 | Hogue | 473/421 |
| 3,836,144 | 9/1974 | Mahoney | 473/421 |
| 4,083,559 | 4/1978 | Owen, Jr. . | |
| 4,127,267 | 11/1978 | Bay et al. . | |
| 4,210,326 | 7/1980 | Booth et al. . | |
| 4,239,235 | 12/1980 | Torres | 473/421 |
| 4,326,717 | 4/1982 | McClimon . | |
| 4,417,728 | 11/1983 | Hay et al. . | |
| 4,421,318 | 12/1983 | Sverdlik et al. . | |
| 4,489,941 | 12/1984 | Shieh . | |
| 4,523,760 | 6/1985 | Bedbarczuk . | |
| 4,913,439 | 4/1990 | Ellington . | |
| 4,932,657 | 6/1990 | Hailer et al. . | |
| 5,205,564 | 4/1993 | Lamberti et al. . | |
| 5,308,083 | 5/1994 | Grunfeld et al. . | |
| 5,407,211 | 4/1995 | Bottiglieri | 473/421 |
| 5,433,434 | 7/1995 | Helmetsie . | |
| 5,584,480 | 12/1996 | Grimsrud . | |
| 5,613,922 | 3/1997 | Hsiang | 473/435 |

*Primary Examiner*—Theatrice Brown
*Attorney, Agent, or Firm*—Roth & Goldman

[57] ABSTRACT

An adjustable ball backstop is disclosed comprising a frame and an elasticly stretched net having upper and lower generally rectangular sections, the lower section being disposed at a fixed angle relative to the vertical and the upper net section being easily adjustable such that the plane of the upper net section may be positioned at a selected angle so as to selectively direct a ball or other projectile back at a selected angle to facilitate practice of sports such as baseball, softball, tennis and the like.

12 Claims, 2 Drawing Sheets

FIG. 2
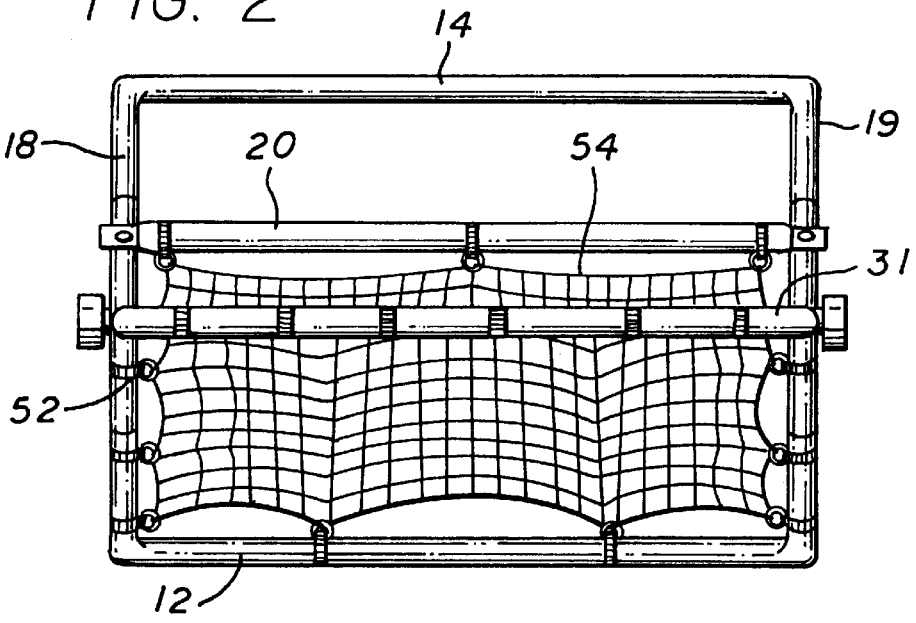
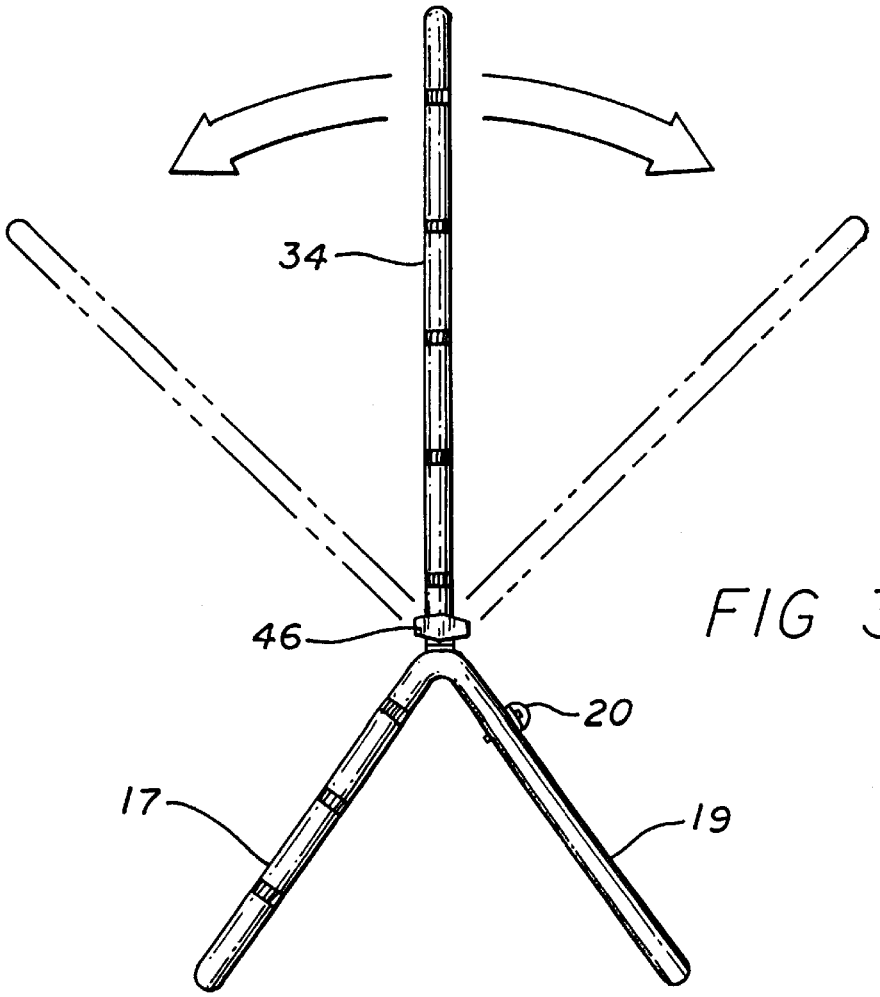
FIG 3

ADJUSTABLE BALL BACKSTOP

CROSS REFERENCE TO RELATED APPLICATIONS, IF ANY

None

BACKGROUND OF THE INVENTION AND PRIOR ART

1. Field of the Invention

The present invention relates to practice backstops for practicing ball sports such as baseball, softball, tennis and the like and, more particularly, to adjustable backstop particularly useful for practicing baseball fielding or pitching skills.

Sports ball backstops generally fall into two different types. The first comprises those backstops which are merely intended to terminate the flight of a ball by deadening the ball's flight and dropping it to the ground to prevent danger to the players and spectators. Baseball batting cages and screens intended to protect a pitcher from a batted ball are backstops of this first type.

The second type of backstop comprises those which are intended to redirect the ball back toward the thrower or hitter of the ball to enable him or her to perfect tennis or baseball pitching or fielding techniques. The present invention is directed to this latter type of backstop.

2. Prior Art

U.S. Pat. No. 849,941, Titus, dated Apr. 9, 1907 discloses a baseball backstop having an upper section which is angularly adjustable relative to a generally vertically extending lower section, the purpose of such adjustability being so as to stop the ball and preclude any possibility of a ball which has passed the batsman from escaping and being lost. The device is not intended for rebounding the ball and adjustability of the rebound characteristics of the device for fielding or pitching practice is therefore absent.

U.S. Pat. No. 2,944,816 to Dixon dated Jul. 12, 1960 discloses a generally vertically oriented rebound screen or net for practicing pitching or fielding. The net is of generally rectangular configuration and its angle with respect to the vertical can be adjusted.

Another adjustable ball return apparatus is disclosed in Mahoney U.S. Pat. No. 3,836,144 issued Sep. 17, 1974. A single generally rectangular net is supported with its lower edge spaced at a distance above the ground and the net is angularly adjustable to various positions for different uses such as volleyball, basketball, and baseball practice.

Various other backstop type devices are known including some which consist of multiple net sections such as those shown in the Torres U.S. Pat. No. 4,239,235 issued Dec. 16, 1980 wherein the angles of the various net sections are adjustable with respect to each other and wherein the entire multi-section net can be collectively adjusted with respect to its supports.

Although the prior art is replete with various sports nets and rebound apparatus, some of which consist of one or more adjustable sections, there is none designed specifically for adjusting the net structure to vary the desired rebound angle of return in a vertical plane of a ball or other object projected against the backstop.

OBJECT OF THE INVENTION

The primary object of the present invention is accordingly to provide an adjustable ball backstop which includes an elastically supported net comprised of separate sections which are angularly adjustable relative to each other to quickly and selectively vary the direction and angle, in a vertical plane, of rebound of a ball or other object projected thereagainst.

Other objectives and advantages of the invention will become apparent from reading the detailed description which follows.

SUMMARY OF THE INVENTION

The present invention accordingly provides

BRIEF DESCRIPTION OF THE DRAWINGS

FIG. 2 is a plan view of the backstop shown in FIG. 1.

FIG. 3 is a side elevation view of the backstop shown in FIG. 1.

DESCRIPTION OF THE PREFERRED EMBODIMENT

The present invention will be described with reference to a backstop used for baseball practice but it will be understood that the invention, in its broadest aspects, is not limited to its use as a practice device for baseball. For example, the device may be easily used or modified for practice in tennis, racket ball, hand ball or other sports.

Figure 1:
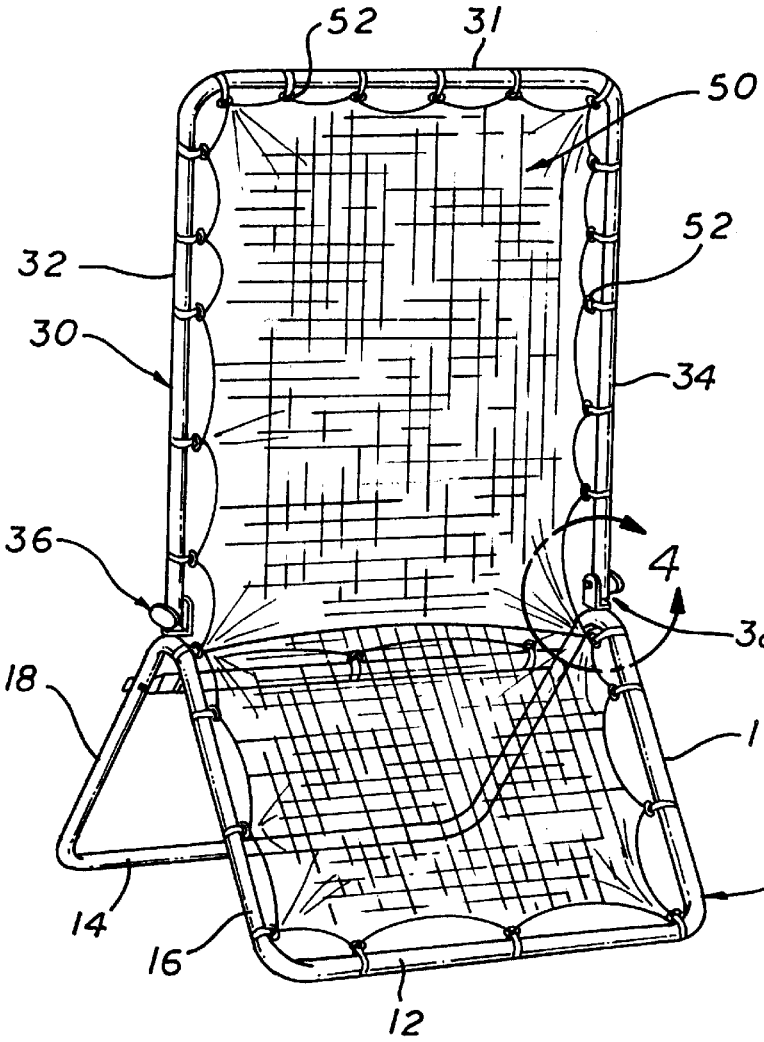
FIG. 1 is a perspective view of an adjustable ball backstop.
Figure 4:
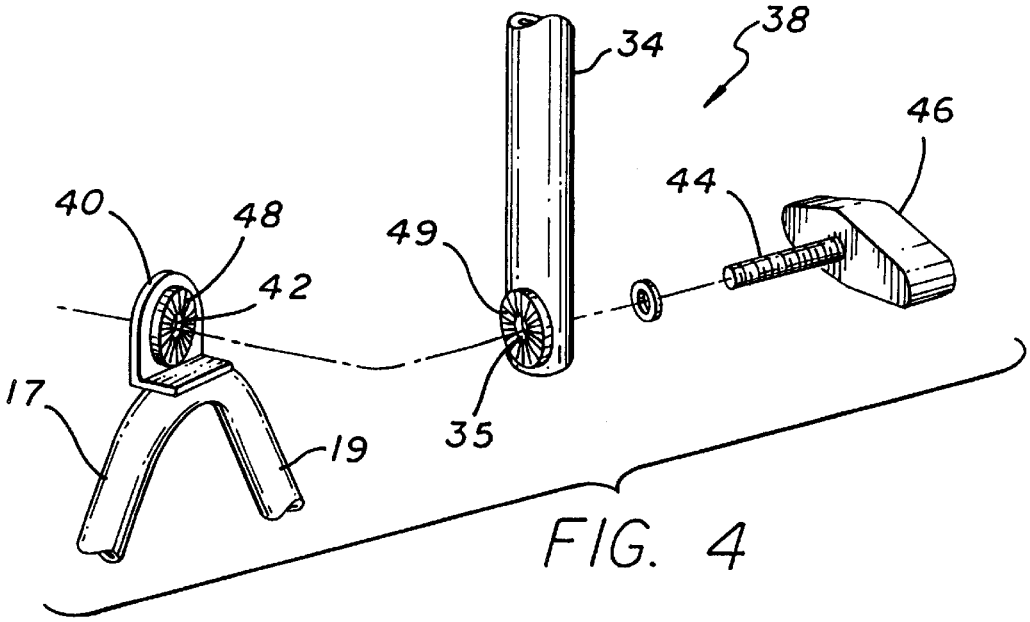
FIG. 4 is an enlarged view of one adjustable connector used in the backstop.

The perspective view of the backstop shown in FIG. 1 discloses that it is comprised of a base section or stand 10 which may be easily bent from a single rectangularly shaped piece of tubular metal such that the shorter sides of the rectangle form a pair of parallel horizontally extended spaced apart ground supports 12, 14 for the stand. The long sides of the rectangle are bent into a generally V shaped configuration such that each long side of the rectangle forms one pair of front and rear support legs 16, 17; 18, 19 joined at the bends of the long sides of the rectangle. A horizontally extending stiffener 20 is attached to the rear support legs 18, 19 at the location shown.

The upper adjustable section 30 of the backstop is comprised of a single tubular member bent to form an inverted U shaped configuration having a top net support 31 and two downwardly extending legs 32, 34 which are each affixed to the respective bends of the support stand 10 in a manner such that the plane of the upper adjustable section 30 may be quickly and easily adjusted from the vertical forwardly or rearwardly as desired and seen in FIG. 3.

For this purpose of easily adjusting the upper section 30, the upper section is affixed to the stand by a pair of adjustable connectors 36, 38, only one of which will be described.

A generally triangular plate 40 is affixed to the apex of the stand legs, the plate 40 having a threaded bore 42 sized to receive a threaded connector shaft 44 to the end of which is affixed an adjustment knob 46.

The lower end of the associated side leg 34 of the upper net section is fastened to the triangular plate 40 and has a through bore 35 aligned with the threaded bore 42 in the connector plate 40. Connector discs 48, 49 having grooved or otherwise roughened frictional facing sides are affixed to the plate 40 and lower end of leg 34 whereby tightening of the connector knob securely holds the upper adjustable section 30 in a vertical position or in a desired angular position relative to base section 10.

The rebound net 50 comprises a relatively inelastic net of rectangular configuration which is attached to the base and upper sections of the frame by a plurality of rings or elastic suspenders 52 at regularly spaced intervals around the periphery of the upper and lower sections of the net. Preferably, the net 50 also has a short tail section 54 connected at spaced intervals to stiffener 20 as shown in FIG. 2.

It will thus be seen that the lower net section extends substantially to the ground toward the user preferably at an angle of approximately 15–20 degrees from the vertical so as to rebound a ball impacted against the lower net section generally upwardly back toward the user of the backstop. Balls impacting against the upper section of the net will be returned at an upward or downward angle back to the user depending on the set position of the upper net section. Thus, balls thrown or hit against the net can easily be rebounded back toward the user in the manner desired for most efficient practice. It will be noted that the net extends upwardly from the ground engaging front support 12 all the way to the top net support 31 of the upper adjustable net section so that balls will not inadvertently pass under or through the net. If desired, a target may also be painted on the net to assist in practicing the desired sport.

Persons skilled in the art will readily appreciate that various modifications can be made from the preferred embodiment thus the scope of protection is intended to be defined only by the limitations of the appended claims.

We claim:

1. An adjustable ball backstop comprising:

a) a stationary frame section comprising a base having at least one pair of front net support legs inclined in a common plane rearwardly from a front side of the backstop; and at least two rear support legs connected to said front support legs;

b) an upper adjustable frame section comprising at least one pair of net support side members extending upwardly from said base support legs;

c) a pair of manually operable connectors attaching said upper adjustable frame section to said stationary frame section, one each of said support side members being adjustably attached by one connector to a respective one of said support legs whereby said upper section extends in a plane defined by said pair of side members which can be angled with respect to the plane defined by said support legs at a desired rebound angle; and d) net means connected to said frame sections whereby said net means has a lower stationary section in the plane defined by said front support legs and an upper adjustable section in the plane defined by said support side members.

2. The backstop of claim 1, further comprising a generally horizontally extending net support member connected between the upper ends of said net support side members, and suspenders connecting an upper edge of said upper net section to said horizontally extending member.

3. The backstop of claim 2, further comprising a front ground support connecting the lower ends of said front support legs to each other.

4. The backstop of claim 3, further comprising a rear ground support connecting the lower ends of said rear support legs to each other.

5. The backstop of claim 4, wherein said net means is a single net having upper and lower sections.

6. The backstop of claim 5, further comprising a stiffener connecting upper extents of said rear support legs to each other.

7. The backstop of claim 6, wherein said net means has a tail section connected to said stiffener.

8. The backstop of claim 6, wherein said net is connected by suspenders to said support sections and said net is relatively unstretchable compared to said suspenders.

9. The backstop of claim 4, wherein each connected pair of said front support legs and rear support legs is formed from a single piece having an apex joining a front support leg and a rear support leg.

10. The backstop of claim 9, wherein said plane defined by said front support legs is inclined at an angle of about 20 degrees with respect to the vertical.

11. The backstop of claim 1, wherein said connectors each comprise frictionally engageable discs and a manually operable connector knob.

12. The backstop of claim 1, wherein said lower section of net extends to the ground.

* * * * *